US005154590A

United States Patent [19]

Klein

[11] Patent Number: 5,154,590

[45] Date of Patent: Oct. 13, 1992

[54] ROTATABLE CYLINDRICAL NEEDLE PLATE WITH DISTINCT NEEDLE HOLES

[75] Inventor: Michael Klein, Bielefeld, Fed. Rep. of Germany

[73] Assignee: Dürkopp Adler Aktiengesellschaft, Fed. Rep. of Germany

[21] Appl. No.: 781,822

[22] Filed: Oct. 23, 1991

[30] Foreign Application Priority Data

Oct. 27, 1990 [DE] Fed. Rep. of Germany ..... 4034230

[51] Int. Cl.[5] ..... D05B 73/12

[52] U.S. Cl. ..... 112/260; 112/121.15; 112/311

[58] Field of Search ..... 112/63, 121.12, 121.13, 112/121.15, 184, 257, 258, 260, 303, 311

[56] References Cited

U.S. PATENT DOCUMENTS

| | | | |
|---|---|---|---|
| 3,313,259 | 9/1967 | Daniel et al. | 112/260 |
| 3,513,795 | 5/1970 | Hagemeyer | 112/260 |
| 4,303,028 | 12/1981 | Takenoya et al. | 112/260 X |
| 4,493,280 | 1/1985 | Bianchi | 112/260 |
| 4,520,744 | 6/1985 | Portilla | 112/260 |
| 4,876,975 | 10/1989 | Braun | 112/260 |
| 4,889,062 | 12/1989 | Orii | 112/260 X |
| 4,991,526 | 2/1991 | Blanc | 112/260 X |

FOREIGN PATENT DOCUMENTS

| | | | |
|---|---|---|---|
| 1660928 | 3/1968 | Fed. Rep. of Germany . | |
| 2924206 | 12/1979 | Fed. Rep. of Germany | 112/260 |
| 0780482 | 8/1957 | United Kingdom | 112/260 |

*Primary Examiner*—Werner H. Schroeder
*Assistant Examiner*—Ismael Izaguirre
*Attorney, Agent, or Firm*—Ostrolenk, Faber, Gerb & Soffen

[57] ABSTRACT

A rotatably mounted needle plate (30) in the form of a cylindrical sleeve is provided for a sewing machine (1) with which seams can be produced as a result of a relative movement between the sewing machine (1) and a cloth holder (68). The needle plate (30) has at least one needle-plate attachment (37) and at least two needle holes (38, 38'), a longitudinal axis (39) of each needle hole (38, 38') being radial to an axis of rotation (40) of the needle plate (30). The needle-plate attachment (37) provides cloth resting surfaces (41) surrounding each needle hole (38, 38') which are at different distances from the axis of rotation (40). By rotating the needle plate (30) there is obtained an adjustment of the sewing level, as a result of which it is assured that the lower side of the cloth will dependably rest on the cloth resting surfaces (41) during the sewing even when the cloth has partially thick regions within the course of the seam. Since both round and slot-shaped needle holes (38, 38') are provided in the needle plate (30) and the cloth resting surfaces (41) of these needle holes (38, 38') are at equal distances from the axis of rotation (40), then different types of stitches (straight stitch or zig-zag stitch) can be present within the same seam.

17 Claims, 4 Drawing Sheets

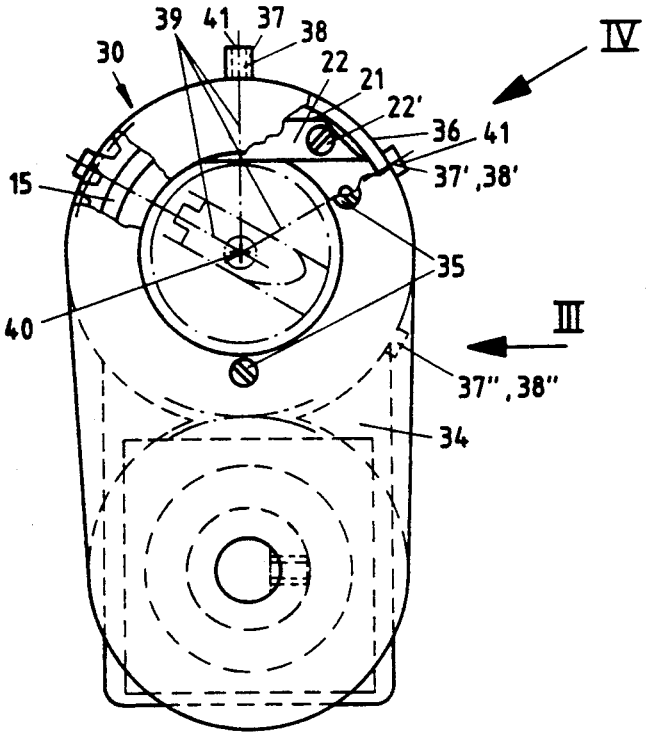
Fig. 2
Fig. 4
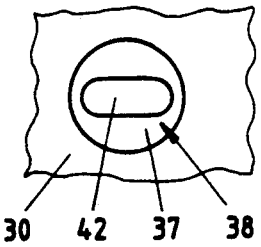
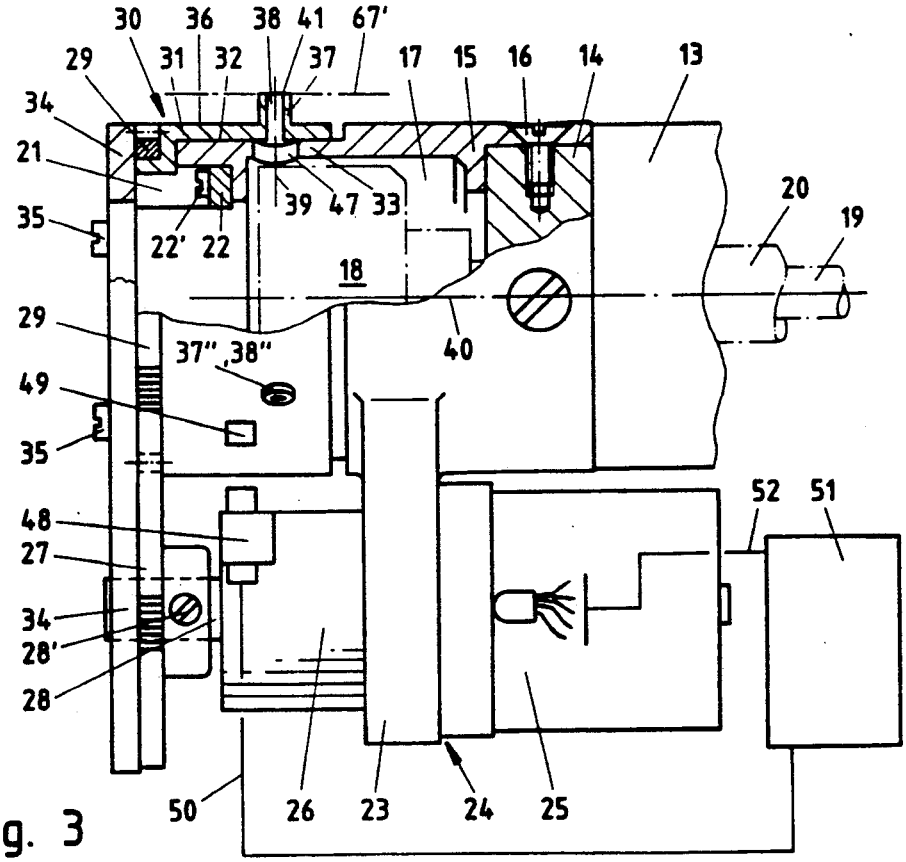
Fig. 3

ROTATABLE CYLINDRICAL NEEDLE PLATE WITH DISTINCT NEEDLE HOLES

BACKGROUND OF THE INVENTION

1. Field of the Invention

The present invention relates to a needle plate, and more particularly to a needle plate for use in a sewing machine which provides a seam as a result of relative movement between the sewing machine and a sewing material holder.

2. Description of the Related Art

A needle plate of this general type is known from German Provisional Patent AS 16 60 928. The known needle plate is intended for a sewing machine for the production of a seam, in which the material to be sewn is clamped between two clamping plates of a cloth holder. The needle plate has a needle-plate attachment, which is provided with a needle hole, extends over the top of the needle plate, and is supported for rotating around an axis of rotation at the plane of movement of the sewing needle, from the operating position into a position which does not extend over the top of the needle plate. In the known needle plate, the needle-plate attachment serves to compensate for the difference in height between the needle plate and the top edge of the lower clamping plate of the cloth holder so that the cloth is not pulled downward by the perforating needle. On the other hand, as a result of the outwardly swung position of the needle-plate attachment, it is possible to replace or transfer the cloth holder without lifting it above the plane of the needle-plate attachment which extends into the cloth holder during the sewing. The disadvantage of the known needle plate is that its sole needle-plate attachment has a constant sewing level. This level is defined by the distance which is determined by a fixed point, for instance, the point of swing of the needle-plate attachment, and the upper edge of the needle-plate attachment which serves as a resting surface for the cloth. A prerequisite for the dependable formation of a seam is, as is known, that the bottom side of the cloth being sewn is supported, when a needle-plate attachment which extends over the needle plate is used, by the upper edge of said attachment so that fluttering of the cloth does not occur upon the penetration of the needle. If thicker regions, due for instance to folds or small parts such as slide fasteners, strips of material or the like, are present on the main part of the cloth within the course of the seam, particularly on the bottom side of the cloth, the position of the upper edge of the needle-plate attachment must correspond to the maximum thickness which occurs. This means, however, that those places which do not have thick regions in the sewing-material part are not supported by the needle-plate attachment, so that flutter-free sewing of cloth provided with partial thick regions which is clamped in a cloth holder is not possible with the known needle plate.

SUMMARY OF THE INVENTION

The central object of the present invention is, therefore, to develop a needle plate whereby, with the cloth clamped in a cloth holder, thicker regions along a seam, as well as thinner regions, can be dependably sewn together.

This object is achieved with a needle plate as disclosed herein.

With the needle plate of the invention, the advantageous result is obtained that, depending on the thickness of cloth which is present at the time at the place of sewing, an adjustment of the sewing level is effected by a corresponding rotation movement of the needle plate. For this purpose, a plurality of needle holes are provided in the rotatably mounted needle plate which have, in their immediate vicinity, cloth resting surfaces which are at different distances from the rotational axis of the needle plate.

A further advantage is obtained if round as well as slot-shaped needle holes are provided in the needle plate of the invention, in which case the cloth resting surfaces which directly surround the needle holes may be at equal distances from the axis of swing of the needle plate. In this case, it is possible, by corresponding swinging movement of the needle plate, to produce different types of stitches within a seam (straight stitch or zig-zag stitch) or to produce a straight stitch with a so-called needle-transport movement.

Other advantageous developments of the needle plate include the rotation in angular steps of the needle plate by a pneumatic-mechanical drive.

Other features and advantages of the present invention will become apparent from the following description of the invention which refers to the accompanying drawings.

BRIEF DESCRIPTION OF THE DRAWINGS

Several embodiments of the invention will be explained with reference to FIGS. 1 to 11. In the drawings:

FIG. 2 is a front view, as seen in the direction II indicated in FIG. 1, of a needle plate;

FIG. 3 is a side view, as seen in the direction III of FIG. 2, of the needle plate, shown partially in section, and of its drive;

FIG. 4 is a top view, as seen in the direction IV of FIG. 2, of an alternate needle-plate attachment which has a slot-shaped needle hole suitable for the formation of zig-zag stitches;

DESCRIPTION OF THE PREFERRED EMBODIMENTS

Figure 1:
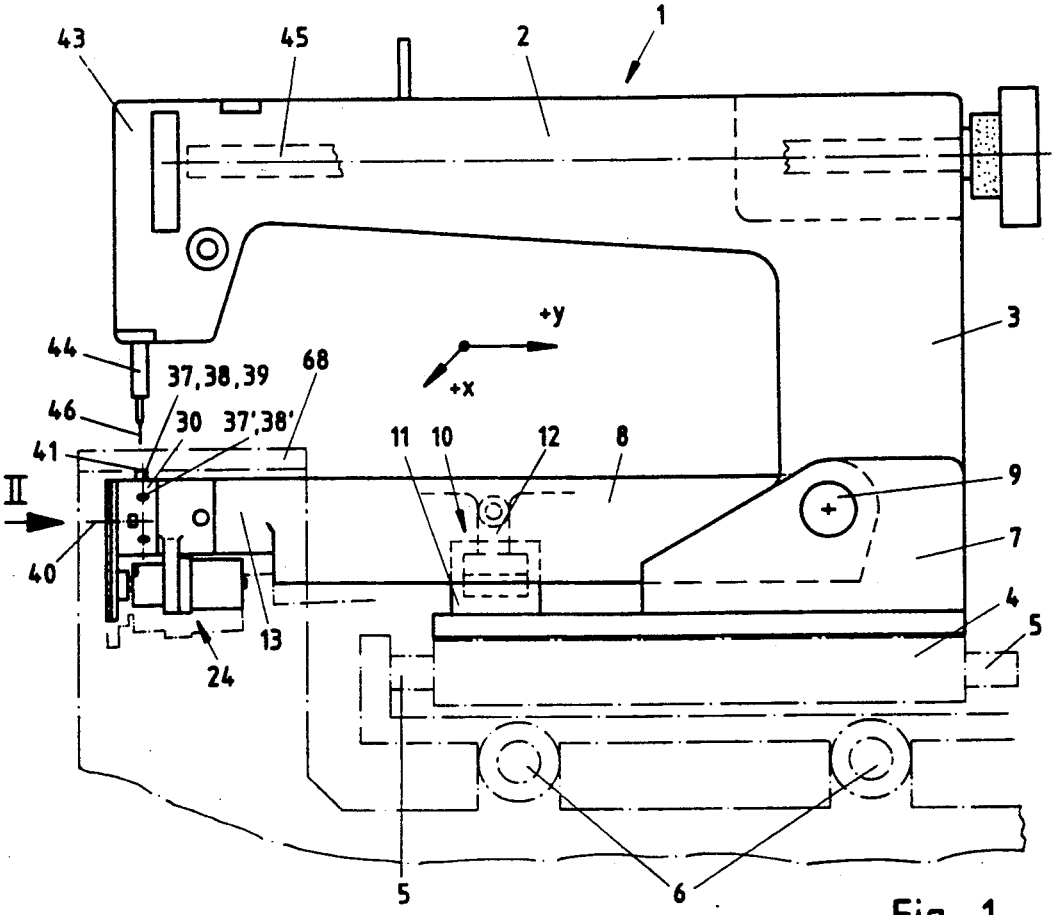
FIG. 1 is a side view of a sewing machine which can be moved in X and Y directions.

FIG. 1 shows a sewing machine 1 with an arm 2 which is firmly attached via a stand 3 to a carriage 4. The latter is moveable via two guide rods 5 in the Y-direction (see FIG. 1) and via two other guide rods 6 in the X-direction (at right angles to the plane of the drawing in FIG. 1). Two side plates 7 are provided on both sides on the stand 3, receiving a base plate 8 between them, as shown in FIG. 1. The latter is mounted for swinging around a bolt 9 which is mounted free of displacement in the side plates 7. The swingability of the base plate 8 is made possible by a setting member 10 shown in simplified fashion in FIG. 1, for instance a double-acting compressed air cylinder having a cylinder tube 11 which is fastened to the carriage 4 and a piston rod 12 which is articulated to the base plate 8.

At its free end, the base plate 8 passes into a cylindrical part 13 which terminates in an attachment 14 (see FIG. 3). The latter receives a bearing bushing 15 which is connected via hexagon screws 16 to the attachment 14. A chamber 17 provided in the bearing bushing 15 receives a known looper 18, indicated schematically here, for instance a double-rotating step-stitch looper. The latter is driven by a looper shaft 19 mounted in the base plate 18. On the looper shaft 19 is mounted a tubular shaft 20 which serves for driving a known thread-cutting device, not shown here. A groove 21 which receives a holding arm 22 is provided in the bearing bushing 15, as shown in FIG. 2. On said holding arm there is provided a holding nose (not shown here) which, in known manner, serves as security against the entrainment of the bobbin housing, also not shown here, which is a part of the looper 18. The holding arm 22 is attached to the bearing bushing 15 by two screws 22', as shown in FIGS. 2 and 3.

On the bearing bushing 15 or on the cylindrical part 13 of the base plate 8, there is provided a bearing lug 23 on which a drive 24 is attached by suitable fastening means, not shown here. The drive 24 consists of a stepping motor 25, a reduction gear 26 driven by the latter, and finally a gear wheel 27 with spur teeth. The latter is detachably connected to a driven shaft 28 by a screw 28'. The driven shaft 28, as shown in FIG. 3, extends out of the reduction gear 26, which is preferably an ordinary commercial planetary gear. The gear wheel 27 engages a gear rim 29 which is also provided with spur teeth and which is attached in suitable manner, for instance, by screws, bonding or soldering, to a needle plate 30, as shown in FIG. 3. The needle plate 30 is developed as a cylindrical sleeve 31 the inner wall 32 of which is received by an extension 33 which is provided on the bearing bushing 15. In this way, the needle plate 30 is mounted for rotation without play on the bearing bushing 15. A mounting plate 34 is attached by the attachment screw 35, as shown in FIGS. 2 and 3, to the bearing bushing 15 on the front side thereof and thus provides form-locked guidance of the rotatable needle plate 30. The free end of the driven shaft 28 is supported in the mounting plate 34.

Figure 11:
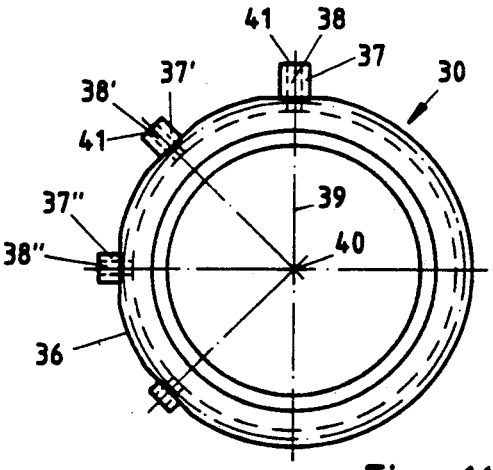
FIG. 11 is a simplified front view of an alternate needle plate provided with a polygonal peripheral surface.

On a circular (see FIG. 2) or a polygonal (see FIG. 11) peripheral surface 36 of the needle plate 30, are provided a plurality of needle-plate attachments 37, 37', 37'', each of which has a needle hole 38, 38', 38'' the longitudinal axis 39 of which is directed, as shown in FIG. 2, radial to an axis of rotation 40 of the needle plate 30. The cloth resting surfaces 41, each of which, in each case, directly surrounds a corresponding needle hole 38, 38', 38'', are at constant angular distances from each other and at different distances from the axis of rotation 40.

Figure 10:
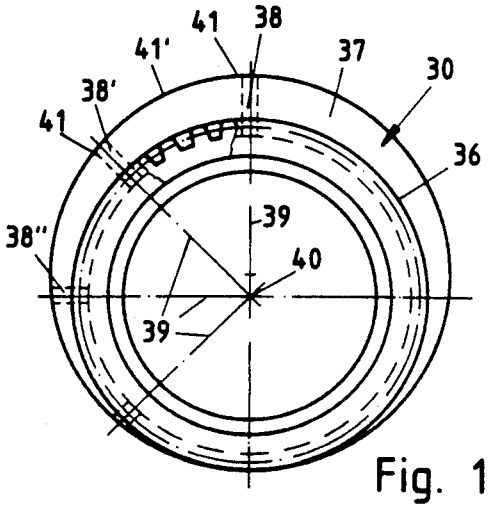
FIG. 10 is a simplified front view of an alternate needle plate provided with an eccentric rib-shaped needle-plate attachment.
Figure 10A:
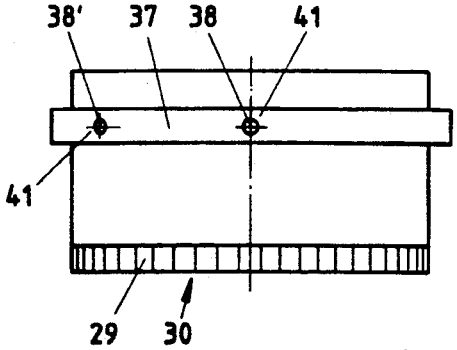
FIG. 10*a* is a top view of the needle plate of FIG. 10.

In another embodiment of the needle plate 30, shown in FIGS. 10 and 10*a*, the circumferential surface 36 thereof is extended radially by a single ribbed needle-plate attachment 37, the latter having a circumference 41 which is arranged eccentrically to the axis of rotation 40. In the needle plate attachment 37, a plurality of needle holes 38, 38', 38'', are provided, each having a longitudinal axis 39 which is radial to the axis of rotation 40. The cloth resting surfaces 41, one of which in each case directly surrounds the corresponding needle hole 38, 38', 38'', are at different distances from the axis of rotation 40.

Each of the needle holes 38, 38', 38'' described above may be of round or oval cross-section, or may be shaped as a slot 42, as shown in FIG. 4.

Within an arm head 43 of the sewing machine 1 is mounted an upwardly and downwardly moving needle bar 44 which is driven by an arm shaft 45, indicated schematically in FIG. 1, which is mounted in the arm 2. The needle bar 44 may also carry out a swinging motion in the direction of transport of the cloth, in addition to its up-and-down movement, if the sewing machine 1 in question is designed for so-called needle transport. In such case, the corresponding needle hole is developed as a slot 42 (FIG. 4) extending in the direction of transport of the cloth.

If the needle bar 44, in addition to its upward and downward movement, also carries out a swinging movement transverse to the direction of transport of the cloth, then zig-zag stitches as well as straight stitches can be produced with the sewing machine 1.

From what has just been said, it follows that the purpose of providing the rotatable needle plate 30 is not limited solely to the adjustment of the sewing level, but that feature is also advantageous if different types of stitches occur within a seam. This is the case when, for instance, zig-zag stitches are present here and there within a straight-stitch seam, the zig-zag stitches requiring a needle hole which is shaped as slot 42 transverse to the direction of transport of the cloth. In such a case, the resting surfaces surrounding the needle holes in the needle plate may advantageously be located at constant distances from the ais of rotation.

During the formation of stitches, a sewing needle 46 guided by the needle bar 44 penetrates, for instance, into the needle hole 38 of the needle-plate attachment 37 which has been brought into the sewing position (see FIG. 1). In order for the tip of the sewing needle 46 to be able to come into the vicinity of the tip of the looper 18 in order to form a stitch, a hole 47, shown in FIG. 3, is provided in the bearing bushing 15, said hole being aligned concentric to the longitudinal axis 39 of each needle hole 38, 38', 38''.

On the drive 24, preferably on the reduction gear 26, there is provided a stationary sensor 48 which, by opto-electronic, inductive or capacitive means, for example, recognizes a mark 49 arranged on the needle plate 30. The sensor 48 is connected by a line 50 to a computer-supported control 51 which, inter alia, may also control the movement of the carriage 4 in the X and Y directions by setting members not shown here, for instance stepping motors. The stepping motor 25 of the drive 24 is also connected by another line 52 to the control 51. When triggered by the sensor 48, the control 51 imparts an angular momentum to the stepping motor 25, so as to cause the needle plate 30 to be brought, prior to its rotational motion, into a well-defined starting position. This process is known as a so-called "zeroing process". The control 51 then gives the stepping motor 25 the impulses necessary for initiating the rotational movement of the needle plate 30.

Figure 9:
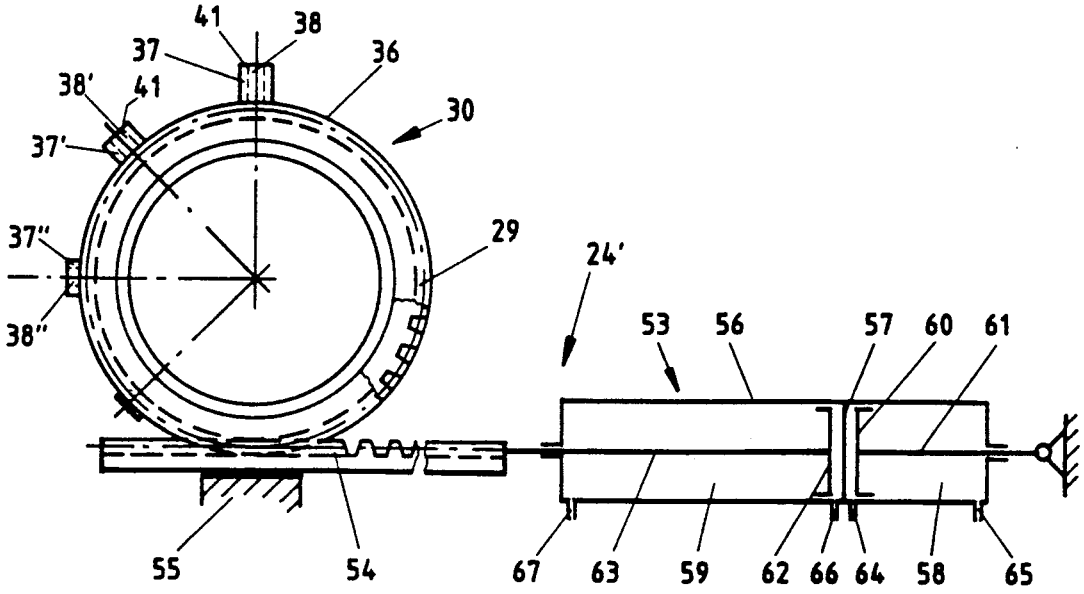
FIG. 9 is a front view of the needle plate which is mounted for being rotated by a rack drive actuated by a pressure fluid.

In another embodiment, the rotation of the needle plate 30 is effected by a drive 24', the construction of which can be noted from the diagram in FIG. 9. The drive 24' consists of a double-acting multi-position cylinder 53 which, after being acted upon by pressure fluid, displaces a rack 54, functionally connected with it, in the direction of the longitudinal axis of the multi-position cylinder 53. The rack 54, which is supported by an abutment 55, engages a toothed rim 29 provided on the needle plate 30. In this way, the needle plate 30 is rotated by the movement of displacement of the rack 54.

The multi-position cylinder 53 consists of a cylindrical tube 56 which is divided by a plate 57 into two chambers 58, 59 separated from each other. Within the chamber 58 is a first piston 60 which is connected to a first piston rod 61. The latter, as shown in FIG. 9, is pivoted to the frame at the end thereof extending out of the cylindrical tube 56. Within the chamber 59 is a second piston 62 which is connected to a second piston rod 63. The rack 54 is connected to the end thereof extending out of the cylindrical tube 56. The chamber 58 has a first hole 64 and a second hole 65 and the second chamber 59 has another first hole 66 and second hole 67.

If the plate 57 is so arranged in the cylindrical tube 56 that the stroke of the piston 62 is twice as great as the stroke of the piston 60, then upon suitable action of pressure fluid on the multi-position cylinder 53, the rack 54 can be displaced by three steps of equal length. As a result of this, the needle plate 30 can be rotated through three angular steps of the same size. For example, in FIG. 9, it can be noted that the rack 54 has momentarily assumed its right-hand end position. If now compressed air is, for instance, fed via the hole 64 between the plate 57 and the piston 60, then the rack 54 is displaced one step to the left since, as a result of the nondisplaceable piston rod 61, the cylindrical tube 56 and, thus, at the same time, the second piston rod 63 also move to the left. On the other hand, if compressed air is fed via the hole 66 between the plate 57 and the piston 62, then the rack 54 is moved two steps to the left from its right-hand starting position. The position of the piston 60 shown in FIG. 9 is made possible by compressed air acting on it which has entered the chamber 58 through the hole 65. If, finally, the rack 54 is to be moved three steps to the left from its right-hand starting position, then compressed air is fed via the hole 64 between the plate 57 and the piston 60 as well as via the hole 66 between the plate 57 and the piston 62.

The compressed air necessary for actuating the multi-position cylinder 53 is obtained via hoses and pneumatic components such as solenoid valves, throttles and the like, not shown here, from an external source of compressed air, also not shown here. The start and duration of the corresponding action is determined by the control 51.

Figure 7:
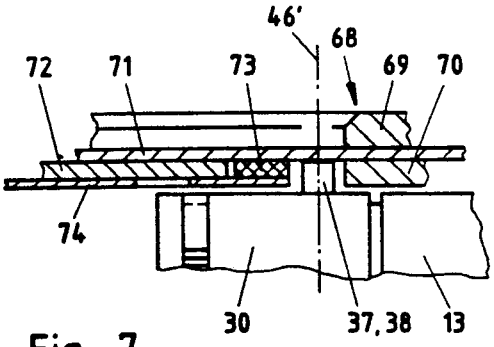
FIG. 7 is a side view of the needle plate and the cloth clamp, with the needle-plate attachment which provides a high sewing level being in correct sewing position.
Figure 8:
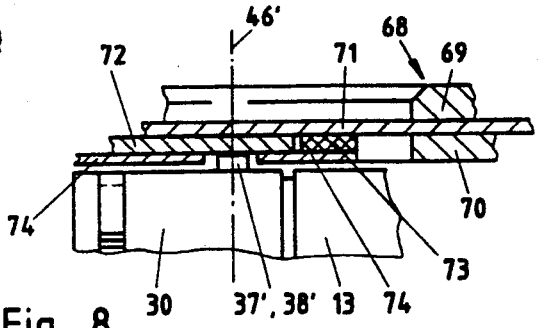
FIG. 8 is a side view of the needle plate and the cloth clamp, with the needle-plate attachment which provides a low sewing level being in correct sewing position.

As can be noted from FIGS. 1 and 3, the sewing machine 1 moves in a sewing plane 67' and along a predetermined path in the X and Y directions relative to a stationary cloth holder 68 which includes an upper clamping plate 69 and a lower clamping plate 70 (see FIGS. 5 to 8). The upper clamping plate 69 is pivotably mounted on the lower clamping plate 70 via a hinge not shown here. Between the two clamping plates 69, 70 there a cloth part is temporarily held, which as a rule consists of a cloth main part 71 and a small part 72 which is to be sewn to it. For the proper positioning of the small part 72 on the main part 71, a spacer 73 as well as a plate 74 are fastened to the upper clamping plate 69 or the lower clamping plate 70. As clearly shown in FIGS. 7 and 8, the small part 72 thus assumes a well-defined position on the main part 71, referred to the path of movement 46' of the sewing needle 46. From FIGS. 7 and 8 it can, furthermore, be noted that layers of cloth of different thickness are to be sewn together. In order to avoid undesired fluttering of the cloth during the sewing, the lower side of the cloth must rest on an abutment which is represented in the case of the needle plate 30 of the invention by the cloth resting surface 41 which directly surrounds each needle hole 38, 38', 38''. As shown in FIGS. 7 and 8, if different thicknesses of cloth are present on a part of the cloth, the needle plate 30 must be rotated, as a function of the thickness of the cloth present at the time, into a position in which the cloth resting surface 41 permits the aforementioned supporting of the lower side of the cloth. In accordance with the invention, the rotation of the needle plate 30 is effected by the drive 24 or 24'. The needle plate 20 can be rotated most simply by manual operation.

Figure 5:
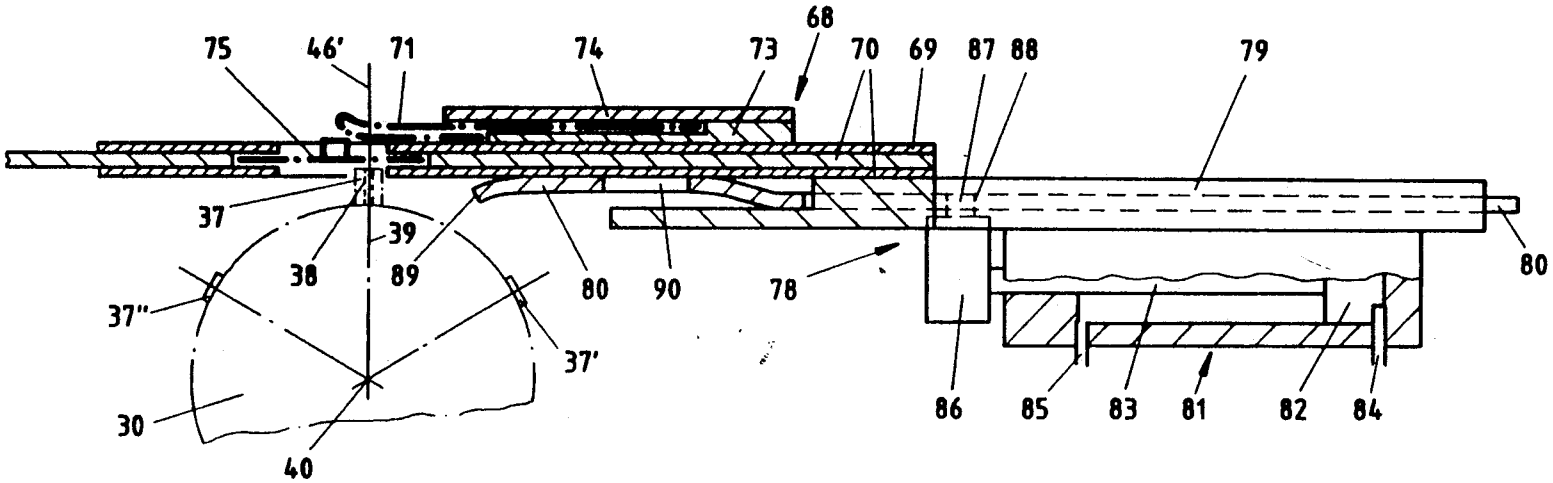
FIG. 5 is a simplified sectional view of a cloth clamp in engagement with a needle-plate attachment which provides a raised sewing level.

The structure of the cloth holder 68 is dependent on the size and shape of the cloth parts 71, 72 which are clamped in nondisplaceable manner in the cloth holder 68. As seen in FIG. 5, for instance, a small part, for instance a slide fastener 75, is arranged below the folded main part 71 in order to be sewn to that part.

Figure 6:
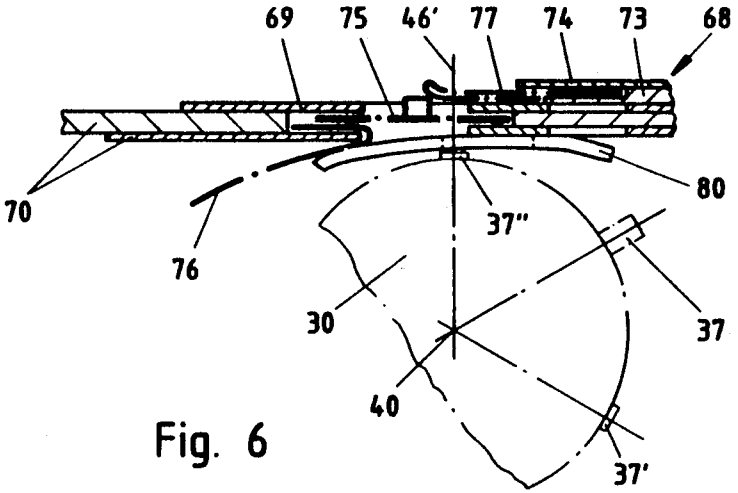
FIG. 6 is a simplified sectional view of the cloth clamp, in engagement with a needle-plate attachment which provides a low sewing level.

With a cloth part of different shape, shown diagrammatically in FIG. 6, a strip of material 76 is to be sewn to the bottom of the slide fastener 75, namely, on the left half of the slide fastener. The last two mentioned parts are clamped, as shown in FIG. 6, in the cloth holder 68 between the upper clamping plate 69 and the lower clamping plate 70. A folded strip 77 is also to be sewn onto the cloth part in question in such a manner that, as shown in FIG. 6, the folded strip 77 is attached to the right-hand half of the slide fastener. In the case of the sewing process just mentioned, it is necessary, however, to avoid sewing the strip of material 76 to the right half of the slide fastener. In order to make certain of this, a slide device 78 is provided on the lower clamping plate 70, as shown in FIG. 5. It includes, inter alia, a frame 79 of U-shaped cross section which is fastened to the bottom of the clamping plate 70. The U-shaped guide channel (not further shown here) receives a slide 80. A double-acting working cylinder 81 which has a piston 82, a piston rod 83 and two holes 84, 85 is fastened to the frame 79, as shown in FIG. 5. The holes are provided for the passage of the pressure fluid, for instance compressed air. Fastened on the free end of the piston rod 83 and secured against turning, is a block 86 which has a driver 87 on top. The driver engages in a hole 88 in the slide 80. The front region of the slide 80 is bent in such a manner that it contacts the corresponding surface of the bottom of the lower clamping plate 70. A front edge 89 of the slide 80 is bent downward. In the front region of the slide 80 is an opening 90 which permits unimpeded passage of the sewing needle 46. If the operating cylinder 81 is acted on by pressure fluid via the hole 84, then the slide 80 is pushed into its left-hand position, as shown in FIG. 6. In that way, the front edge 89 of the slide 80 deflects the strip of material 76 in such a manner that the sewing needle 46 does not pass through it.

The manner of operation of the needle plate of the invention will now be described:

The cloth holder 68 which is loaded with the cloth to be sewn, for instance the main part 71 and at least one small part 72, is inserted at the beginning of a sewing cycle into the corresponding sewing machine FIG. 1. For this purpose, the base plate 8 is in its lowered position, shown in dash-dot lines in FIG. 1, due to the action of the setting member 10. After the proper insertion of the corresponding cloth holder 68, the control 51 gives suitable control commands appropriate to the existing sewing program to the setting members (not shown here) for carrying out the coordinated movement in the X and Y directions of the carriage 4 and thus of the sewing machine 1. In this way, the sewing machine 1 comes into the starting position necessary for the next following sewing process.

In the existing sewing program there are stored, in addition to the data necessary for carrying out the sewing, also data as to the instantaneous thickness of the sewing material. Namely, if different thicknesses of sewing material follow one another in varying sequence within the course of a seam or within several courses of seams forming part of a sewing cycle, then, in accordance with the invention, the needle plate 30 is rotated by an amount depending on the actual thickness of the material then being sewn. Before each rotation, a thread-cutting process, known per se, must be carried out. For initiating the rotation, the control 51 gives off control commands, provided that the base plate 8 is in its lower dot-dash as position shown in FIG. 1, to the drive 24, for instance, rotary impulses to the stepping motor 25. The latter, after the completion of the zeroing process described above carries out a rotary movement which is transmitted via the gear wheel 27 and the gear rim 29 to the needle plate 30. The rotation of the stepping motor 25 is converted by a reduction gear 26, for instance an ordinary commercial planet-wheel gear, into slow motion. In this way, the needle plate 30 carries out a rotating movement around the axis of rotation 40. Thus, the corresponding needle hole 38, 38', 38'' and the sewing-material resting surface 41 surrounding it are placed in correct position for sewing. The setting member 10 now swings the base plate 8 into its operating position, whereupon sewing is effected up to the place at which a change takes place in the thickness of the material being sewn or where the corresponding course of the seam is at an end. Then the thread-cutting process is again carried out and the base plate 8 is lowered into its position shown in dash-dot lines (see FIG. 1). Further rotations of the needle plate 30 for regulation of the sewing level or change in needle hole type are carried out in the manner described above.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. In combination, a sewing machine and a needle plate used therein, the needle plate having at least one needle-plate attachment provided on the needle plate and having at least two needle holes, the needle-plate attachment being disposed for supporting sewing-material being sewn by the sewing machine;

the needle-plate being rotatable around an axis of rotation which lies at a plane of movement of an upwardly and downwardly movable sewing needle of the sewing machine, and is parallel to a sewing plane of material being sewn;

a longitudinal axis of each needle hole being radial to the axis of rotation.

2. The combination according to claim 1, further comprising a drive for rotating the needle plate.

3. The combination according to claim 2, further comprising programmable control means for controlling said drive.

4. The combination according to claim 3, wherein said sewing machine produces a seam as a result of a relative movement between the sewing machine and a sewing material holder, and said control means is controls said relative movement between the sewing machine and sewing-material holder.

5. The combination according to claim 3, wherein said control means further comprises a sensor on the sewing machine which recognizes a specific starting position of the needle plate.

6. The combination according to claim 3, wherein a respective plurality of cloth resting surfaces surround the needle holes and are at equal angular distances from the axis of rotation.

7. The combination according to claim 2, wherein the drive comprises a stepper motor which is fixed to the sewing machine and a transmission interconnecting the stepper motor and the needle plate.

8. The combination according to claim 5, wherein the transmission comprises a reduction gear on the motor, and a gear wheel on the needle plate.

9. The combination according to claim 8, wherein the reduction gear is a planetary gear.

10. The combination according to claim 2, wherein the drive comprises a multi-position pressure-fluid cylinder and a rack which is fastened to a piston rod of the multi-position cylinder.

11. The combination according to claim 1, wherein the needle plate is developed as a cylindrical sleeve and has a circumferential surface which is concentric with the axis of rotation.

12. The combination according to claim 11, wherein a plurality of needle-plate attachments, each having a respective needle hole, are distributed over the circumferential surface of the needle plate.

13. The combination according to claim 11, wherein said needle holes are in an elongated rib-shaped needle-plate attachment, a periphery of which is eccentric to the axis of rotation, extending over the circumferential surface of the needle plate.

14. The combination according to claim 11, wherein the circumferential surface of the needle plate is generally polygonal and has faces, each having a respective needle-plate attachment.

15. The combination according to claim 1, wherein the cross-section of a needle holes is round.

16. The combination according to claim 1, wherein a cross-section of the needle holes is an elongated oval or slot.

17. The combination according to claim 1, wherein a respective plurality of cloth resting surfaces surround the needle holes and are at different distances from the axis of rotation.

* * * * *